US008371200B2

(12) United States Patent
Zhang

(10) Patent No.: US 8,371,200 B2
(45) Date of Patent: Feb. 12, 2013

(54) MITER BOX WITH ADJUSTABLE CLAMPS

(75) Inventor: Yu Jun Zhang, Shanghai (CN)

(73) Assignee: Meridian International Co., Ltd. (CN)

( * ) Notice: Subject to any disclaimer, the term of this patent is extended or adjusted under 35 U.S.C. 154(b) by 585 days.

(21) Appl. No.: 12/364,946

(22) Filed: Feb. 3, 2009

(65) Prior Publication Data

US 2009/0260499 A1 Oct. 22, 2009

(30) Foreign Application Priority Data

Apr. 22, 2008 (CN) ..... 2008 2 0057550 U

(51) Int. Cl.
*B26D 7/01* (2006.01)
*B26D 7/26* (2006.01)

(52) U.S. Cl. ..... 83/762; 83/468; 83/581

(58) Field of Classification Search ..... 83/765, 83/468, 762–764; 269/287, 288, 290–295; 144/286.1, 286.5
See application file for complete search history.

(56) References Cited

U.S. PATENT DOCUMENTS

| | | | | | |
|---|---|---|---|---|---|
| 477,233 | A | * | 6/1892 | Soukup | 83/767 |
| 565,652 | A | * | 8/1896 | Walter et al. | 83/765 |
| 1,092,518 | A | * | 4/1914 | Brooks | 83/435.11 |
| 1,994,957 | A | * | 3/1935 | Miller | 144/253.1 |
| 2,618,300 | A | * | 11/1952 | Freudenthaler | 83/468 |
| 3,782,235 | A | | 1/1974 | Curcio | |
| 4,051,758 | A | * | 10/1977 | Livick | 83/437.2 |
| 4,256,000 | A | * | 3/1981 | Seidel | 83/468 |
| 4,300,755 | A | * | 11/1981 | Potvin | 269/87.2 |
| 4,712,462 | A | * | 12/1987 | Cvek | 83/762 |
| 4,785,550 | A | * | 11/1988 | Wilkins | 33/633 |
| 5,647,258 | A | * | 7/1997 | Brazell et al. | 83/438 |
| 6,393,958 | B1 | | 5/2002 | Owens et al. | |
| 6,662,699 | B1 | | 12/2003 | Schmidt | |
| 2002/0029678 | A1 | * | 3/2002 | Erisoty | 83/766 |

* cited by examiner

*Primary Examiner* — Omar Flores Sanchez
(74) *Attorney, Agent, or Firm* — Jason R. Sytsma; Shuttleworth & Ingersoll, PLC

(57) ABSTRACT

The present invention relates to a miter box. Miter boxes have a base, a pair of opposed side walls, and at least one aligned slot in the side walls. An embodiment of the present invention includes at least one guide rail mounted on the base perpendicular to the side wall. Further, a clamping assembly is positioned on the guide rail. The clamping assembly is selectively moveable along said guide rail. In this manner, a work piece can be secured to the miter box to hold the piece in position while it is being cut.

13 Claims, 2 Drawing Sheets

MITER BOX WITH ADJUSTABLE CLAMPS

CROSS-REFERENCE TO RELATED APPLICATIONS

The present application claims priority under 35 USC §119 to Chinese application 200820057550.7 filed Apr. 22, 2008, which is incorporated herein by reference.

BACKGROUND

Miter boxes have been in use for many years. Miter boxes are used for cutting pieces of wood at a pre-determined angle. The miter box has aligned slots in the side walls to allow the user to position the saw. The slots prevent the saw from moving or shifting away from position. When using the miter box the user must use one hand to hold the work piece and the miter box while using the other hand to cut. As a result often the work piece will move or the miter box will slide across the table. Attempts to solve this problem have resulted in miter boxes that are expensive to manufacture and complicated to use.

SUMMARY OF THE INVENTION

The present invention relates to a miter box. Miter boxes have a base, a pair of opposed side walls, and at least one aligned slot in the side walls. An embodiment of the present invention includes at least one guide rail mounted on said base perpendicular to the side wall. Further, a clamping assembly is positioned on the guide rail. The clamping assembly is selectively moveable along the guide rail. In this manner, a work piece can be secured to the miter box to hold the piece in position while it is being cut.

DETAILED DESCRIPTION

Figure 1:
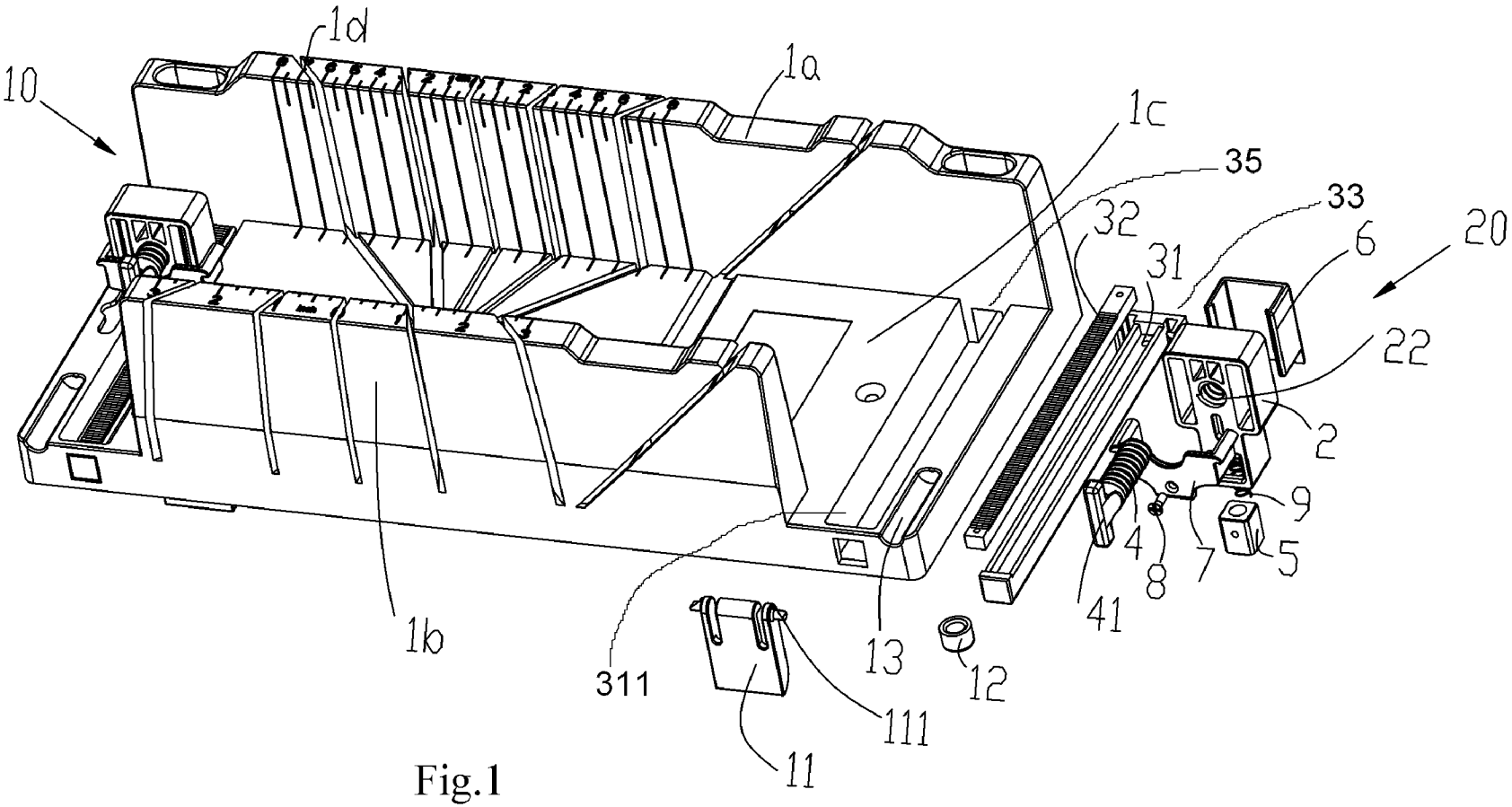
FIG. 1 is a perspective view, party exploded, of an embodiment of the invention.
Figure 2:
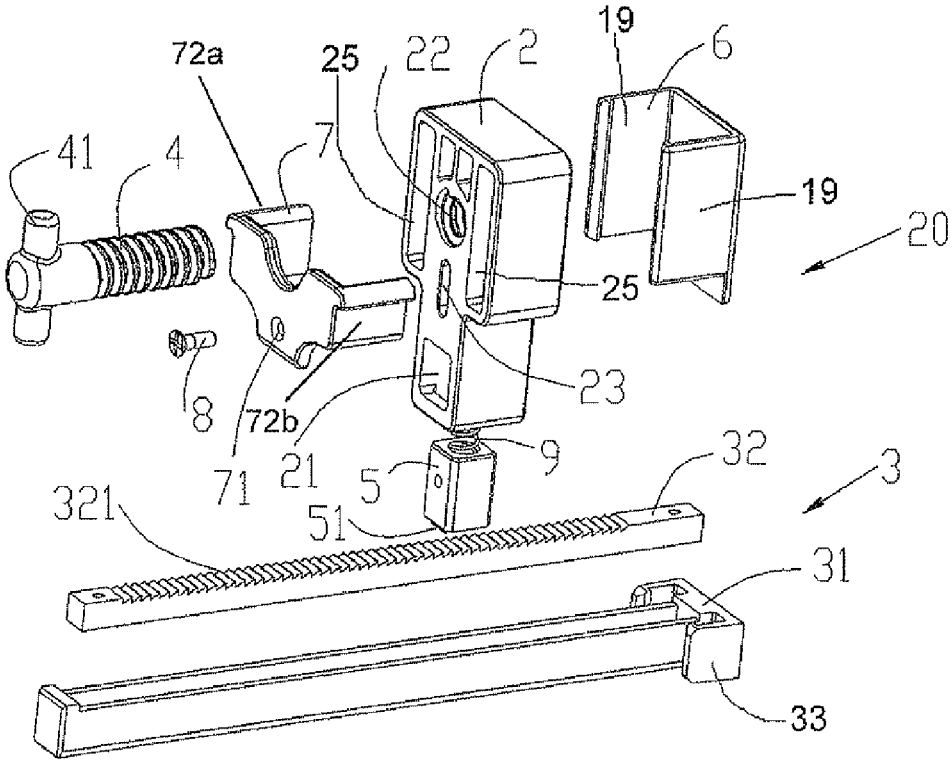
FIG. 2 is an exploded view of an embodiment of the clamping and locking assembly.
Figure 3:
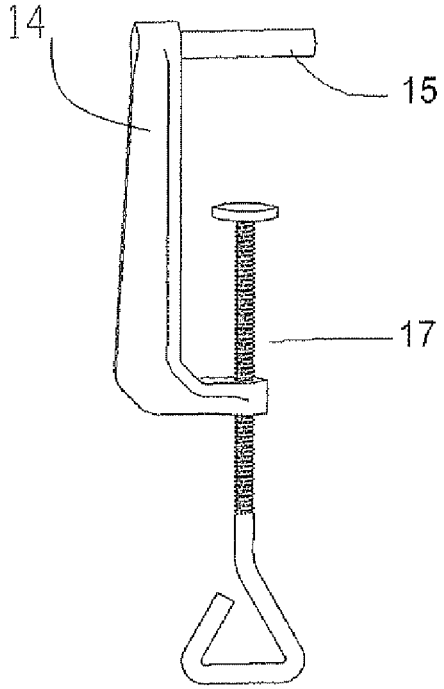
FIG. 3 is a perspective view of an embodiment of the c-clamp that may be used to hold the miter box.

Referring to FIG. 1 is an illustration of an embodiment of the invention. The miter box 10 comprises an elongated base 1*c* with opposed side walls 1*a* and 1*b*. The miter box has at least one and preferably six aligned slots 1*d* cut into each side wall so that a saw is guided into position and held in the position while cutting. This allows the user to quickly and accurately cut angles including 90, 45, and 22.5 degrees. The top face of side walls 1*a* and 1*b* may have measurement marks which also aide the user in measuring the work piece for cutting.

In an embodiment, the miter box may also have one or more bracing legs 11 in alignment on the under side of the miter box 10. Miter box 10 is formed to have a receptacle for pivot pin 111. Pivot pin 1111 attaches the leg 11 to miter box 10. This allows the user to pivot the legs 11 down and place the miter box 10 against the end of a table. The legs 11 brace miter box 10 against the table preventing the miter box 10 from sliding forward when the user is cutting. In addition to bracing legs 11, an embodiment may also have foot pads 12 on each corner of miter box 10. The foot pads 12 provide friction to allow the miter box 10 to be placed on a smooth surface.

An embodiment may also include one or preferably two surfaces 13 adapted to receive c-clamp 14. The surface provides a location to place the fixed end of the c-clamp 14. In an embodiment, the surface 13 is rounded to receive a c-clamp 14 with a rounded fixed end 15. This allows the user to place the fixed end 15 of the c-clamp 14 on the miter box 10 and clamp the adjustable end 17 of the c-clamp 14 to the underside of a table. This arrangement prevents the miter box 10 from sliding while the user is cutting. While, an embodiment may include a rounded surface 13, it should be understood that an alternate embodiment may provide a flat surface for a c-clamp 14 with a flat fixed end surface to rest.

In an embodiment, the elongated base 1*c* may also include one or preferably two channels 311 formed in the base 1*c*. The channels 311 are at opposite ends and extend the length of the base 1*c*. In an embodiment the channels extend through the thickness of base 1*c*.

Each channel 311 is adapted to receive a guide rail 31. Guide rail 31 is a rectangular rail that fits inside the channel 311 and has a clasp 33 that engages in an opening 35 at one end of the side wall 1*a* to secure the rail 31 to the miter box 10. The end 37 of the rail 31 opposite the clasp 33 is engaged in an opening 39 at the lower end of the side wall 1*b* to further secure rail 31 to the miter box. The rail 31 is removable so the user can clean the miter box 10. It should be understood that the guide rails do not necessarily need to be placed in the channels. The guide rails may be mounted on the top surface of elongated base 1*c*.

The guide rail 31 provides a track for clamping assembly 20 to traverse. The clamping assembly 20 is selectively positioned along the track depending on the size of the work piece. In an embodiment, the clamping assembly 20 included a main body 2 having an opening 21 through which the guide rail extends so that the user can slide the clamping assembly 20 to abut the work piece. This is considered the course adjustment.

The course adjustment 3 includes a gear rack 32 that is seated in and forms a part of the guide rail 31. Ratchet 5 has gears 51 on the underside which mesh with notches 321 on gear rack 32. In this arrangement, the clamp assembly 20 forward traverses along the rack 32 with minimal external force. When motion stops, ratchet 5 is urged into its meshing position by spring 9. Backward traverse is not possible without disengaging ratchet 5 because of the angle at which the notches 321 on the rack 32 are made.

The locking assembly of an embodiment includes a release 7 that includes a pair of arms 72*a* and 72*b* that extend to opposite sides of the main body 2 and are moveably secured to the main body 2 to disengage ratchet 5. The user causes upward motion on release 7 which raises ratchet 5 upward disengaging mating gears 51 from gear rack 32. This allows the user to slide the clamping assembly 20 backward, away from the work piece. Ratchet 5 is fixed to release 7 by screw 8 that extends through opening 71 in release 7 into an opening 23 in the main body 2. When upward motion is applied to release 7, by grasping the pair of arms 72*a* and 72*b*, spring 9 is depressed by the screw's 8 movement within opening 23. When release 7 is released, spring 9 urges ratchet 5 into rest position mating gears 51 with gear track 32.

In an embodiment the clamping assembly 20 may include a fine adjustment. Fine adjustment includes a screw 4 engaged in hole 22 in main body 2 which presses upon plate 6. Plate 6 has spaced-apart panels 19 slidable in slots 25 in the main body 2. As screw 4 is turned by handle 41 clockwise the screw traverses out of hole 22 and engages plate 6 pushing plate 6 outward. Pressure against the plate 6 is relieved by turning screw 4 counter-clockwise.

The course and fine adjustment cooperate by allowing the user to push clamp assembly 20 forward along the gear rack 32 up against a work piece. The user may then engage the fine adjustment by turning screw 4 to move plate 6 causing more pressing force against the work piece which further prevents the work piece from moving. When the user is finished cutting, the user releases pressure by turning screw 4 counter-clock wise and then disengaging ratchet 5 and sliding assembly 20 backward.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is:

1. A miter box for clamping a work piece in place so as to provide for cutting the work piece at selected angles, the miter box comprising:

a rectangular elongated base having a top surface to support the work piece and at least one channel formed in the top surface perpendicular to the side wall;

a pair of opposed side walls extending vertically from the base and having opposing inner faces, wherein the sidewalls have at least one slot in alignment with each other;

at least one guide rail positioned in the channel perpendicular to the side wall and having an integrated gear rack along a top surface of the guide rail; and at least one clamping assembly positioned on the guide rail selectively moveable along the guide rail to clamp a work piece in a selected position, the clamping assembly having downwardly biased ratchet teeth to mesh with the integrated gear rack, the ratchet teeth are moved upward by a release that has a pair of arms that extend on opposite sides of the clamping assembly to allow a user to grasp with two fingers and move the ratchet teeth upward so the clamping assembly can be moved away from the work piece.

2. The miter box of claim 1, wherein the clamping assembly further comprises a fine adjustable clamping assembly.

3. The fine adjustable assembly of claim 2, further having a screw member adapted to engage a plate, wherein operating the screw member causes the plate to extend outwardly to increase clamping force against a work piece.

4. The miter box of claim 1 further comprising a surface, a c-clamp having a fixed portion adapted to engage the surface wherein the c-clamp holds the miter box to a work surface.

5. The miter box of claim 1, further comprising at least one bracing leg pivotally attached to the underside of the miter box, wherein the bracing leg engages the end of a work surface to secure the miter box to a work surface.

6. A miter box for clamping a work piece in place so as to provide for cutting the work piece at selected angles, the miter box comprising:

a rectangular elongated base having a top surface to support the work piece and at least one channel formed in the top surface perpendicular to the side wall;

a pair of opposed side walls extending vertically from the base and having opposing inner faces, wherein the sidewalls have at least one slot in alignment with each other;

at least one guide rail with a rectangular cross-section positioned in the channel perpendicular to the side wall and having an integrated gear rack along a top surface of the guide rail; and at least one clamping assembly positioned on the guide rail selectively moveable along the guide rail, the clamping assembly having a square-shaped aperture extending therethrough to receive the guide rail such that the clamping assembly moves along the guide rail, and downwardly biased ratchet teeth to mesh with the integrated gear rack, the ratchet teeth are moved upward by a release that has a pair of arms that extend on opposite sides of the clamping assembly to allow a user to grasp with two fingers and move the ratchet teeth upward so the clamping assembly can be moved away from the work piece.

7. The miter box of claim 6, wherein the clamping assembly further comprises a fine adjustable clamping assembly.

8. The miter box of claim 7, wherein the fine adjustable clamping assembly includes a plate and a screw member adapted to engage the plate, wherein operating the screw member causes the plate to extend outwardly to engage a work piece to increase clamping force against the work piece.

9. The miter box of claim 6 further comprising a surface, a c-clamp having a fixed portion adapted to engage the surface, wherein the c-clamp holds the miter box to a work surface.

10. The miter box of claim 6, further comprising at least one bracing leg pivotally attached to underside of the miter box, where in the bracing leg engages the end of a work surface to secure the miter box to the work surface.

11. A miter box for clamping a work piece in place so as to provide for cutting the work piece at selected angles, the miter box comprising:

a rectangular elongated base having a top surface to support the work piece a pair of opposed side walls perpendicular, extending vertically from the base, and having opposing inner faces, wherein the sidewalls have at least one slot in alignment with each other and at least one channel formed in the top surface perpendicular to the side walls;

at least one guide rail positioned in the channel perpendicular to the side wall and having an integrated gear rack along a top surface of the guide rail; and at least one clamping assembly with a square-shaped aperture extending therethrough to receive the guide rail therethrough and selectively moveable move along the guide rail to a predetermined position abutting the work piece to hold the work piece in position for cutting, wherein the clamping assembly further comprises, a downwardly biased gear teeth positioned in a cavity above the aperture and adapted to mesh against the gear rack and hold the clamping assembly at the predetermined position on the guide rail, wherein the gear teeth have an engaged position where the gear teeth extend into the aperture to engage the guide rail and a release position where the gear teeth are moved upward away from the gear rack;

a release that has a pair of arms that extend on opposite sides of the clamping assembly to allow a user to grasp with two fingers and move the ratchet teeth upward so the clamping assembly can be moved away from the work piece, wherein upward motion of the release disengages the locking assembly from the guide rail; and a fine adjustable clamping assembly having a plate and a screw member adapted to engage the plate, wherein operating the screw member causes the plate to extend outwardly to increase clamping force against a work piece.

12. The miter box of claim 11 further comprising a surface, a c-clamp having a fixed portion adapted to receive the surface, wherein the c-clamp holds the miter box to a work surface.

13. The miter box of claim 11, further comprising at least one bracing leg pivotally attached to underside of the miter box, where in the bracing leg engages the end of a work surface to secure the miter box to the work surface.

* * * * *